US006470515B1

(12) United States Patent
Hsia

(10) Patent No.: US 6,470,515 B1
(45) Date of Patent: Oct. 29, 2002

(54) FOLDABLE FRAME FOR PLAY PEN AND COT

(76) Inventor: Ben M Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 09/903,093

(22) Filed: Jul. 10, 2001

(51) Int. Cl.[7] ..... A47D 7/00

(52) U.S. Cl. ..... 5/99.1; 403/170; 403/184; 135/123; 135/120.3

(58) Field of Search ..... 5/99.1, 93.1, 101–103; 135/87, 123, 120.2, 120.3; 403/169–171, 217, 180, 184, 299, 353

(56) References Cited

U.S. PATENT DOCUMENTS 6,192,535 B1 * 2/2001 Warner et al. ..... 5/99.1

6,233,759 B1 * 5/2001 Warner et al. ..... 5/99.1

* cited by examiner

*Primary Examiner*—Thomas B. Will
*Assistant Examiner*—Tara L. Mayo
(74) *Attorney, Agent, or Firm*—Raymond Y. Chan; David and Raymond Patent Group

(57) ABSTRACT

A foldable frame for play pen and cot includes a pair of parallel top frame units each having an affixing end and a locking end, a pair of first top joints each having a transverse tubular sleeve, a pair of second top joints each having a transverse locking slot. A rotatable locker is affixed to each of the locking ends of the top frame units and arranged in such a manner that each top frame unit is slidably penetrated through the locking slot of the second top joint until the affixing end of the top frame unit is fittedly inserted into the tubular sleeve of the first top joint and the rotatable locker is adjustably locked up with the second top joint, so as to detachably mount the top frame unit between the first and second top joints.

20 Claims, 5 Drawing Sheets

FOLDABLE FRAME FOR PLAY PEN AND COT

BACKGROUND OF THE PRESENT INVENTION

1. Field of Invention

The present invention relates to baby accessories, and more particularly to a foldable frame for play pen and cot which is constructed to be folded up into a compact unit for storage and carriage. Thus, the foldable frame for play pen and cot provides a rigid structure so as to prevent the play pen and cot from being shaken and rocked.

2. Description of Related Arts

Either the play pen or cot is used to restrict the movement of a baby who is able to trail or walk when the parents are able to keep their eyes on their babies. In order to save space for travel and storage, most of the play pens and cots have a foldable design to reduce their sizes.

Conventional foldable pen and cot comprise a foldable frame having a plurality of joints pivotally connecting with a plurality of supporting rods to form an open box structure, so that a baby can be put inside a cloth made boundary to restrict his or her movement. However, uncountable complains report that babies are likely to be hurt due to the unwanted folding up of the play pen and cots accidentally.

Moreover, any structure that can be folded would not has a rigid structure due to the clearance existing in those foldable joints, so that the conventional foldable play pen and cot has another adverse effect of rocking and shaking. In other words, the conventional play pen and cot fails to provide an absolutely safety environment for the babies.

Since the conventional foldable play pen and cot contains too many joints, it not only unreasonably increases the manufacturing cost thereof, but also provides construction weakness at those joints. Most foldable play pens and cots break at such weakened joint structures that make the products being not durable enough.

It is unreasonable to place the babies in a risky or unsafe situation. However, we have to tolerate the above mentioned suffering drawbacks until an improved innovative play pen and cot structure, that can provide an absolutely safe boundary for the babies and still can reduce its size when it is not used to save the travel or storage space, is developed.

SUMMARY OF THE PRESENT INVENTION

A main object of the present invention is to provide a foldable frame for play pen and cot which is facilitated to be folded up into a compact unit for storage and carriage.

Another object of the present invention is to provide a foldable frame for play pen and cot, which provides rigid structure so as to prevent the play pen and cot from being shaken and rocked.

Another object of the present invention is to provide a foldable frame for play pen and cot, wherein the weight of the user applied on the foldable frame will further ensure the folded position of the play pen and cot to avoid an unwanted folding up motion of the play pens and cots accidentally.

Another object of the present invention is to provide a foldable frame for play pen and cot, which has a simple construction that every individual is able to fold and unfold the pen/cot.

Another object of the present invention is to provide a foldable frame for play pen and cot that can be used in any location without using tools for assembly or disassembly.

Accordingly, in order to accomplish the above objects, the present invention provides a foldable frame for play pen and cot, which comprises:

a top frame comprising a pair of parallel top frame bars and a pair of parallel top frame units to form a rectangular structure wherein each of the top frame units has an affixing end and a locking end;

a supporting frame comprising four supporting posts;

a base frame;

a pair of first top joints, each having a transverse tubular sleeve, for connecting two ends of the two top frame bars with upper ends of the two supporting posts respectively;

a pair of second top joints, each having a transverse locking slot, for connecting the other two opposed ends of the two top frame bars with upper ends of the other two supporting posts respectively, wherein each of the top frame units is detachably connected between the first top joint and the second top joint;

four base joints for connecting bottom ends of the four supporting posts with the base frame respectively; and a rotatable locker affixed to each of the locking ends of the top frame units and arranged in such a manner that each top frame unit is slidably penetrated through the locking slot of the second top joint until the affixing end of the top frame unit is fittedly inserted into the tubular sleeve of the first top joint and the rotatable locker is adjustably lock up with the second top joint so as to securely lock up the top frame unit between the first and second top joints.

DETAILED DESCRIPTION OF THE PREFERRED EMBODIMENT

Figure 1:
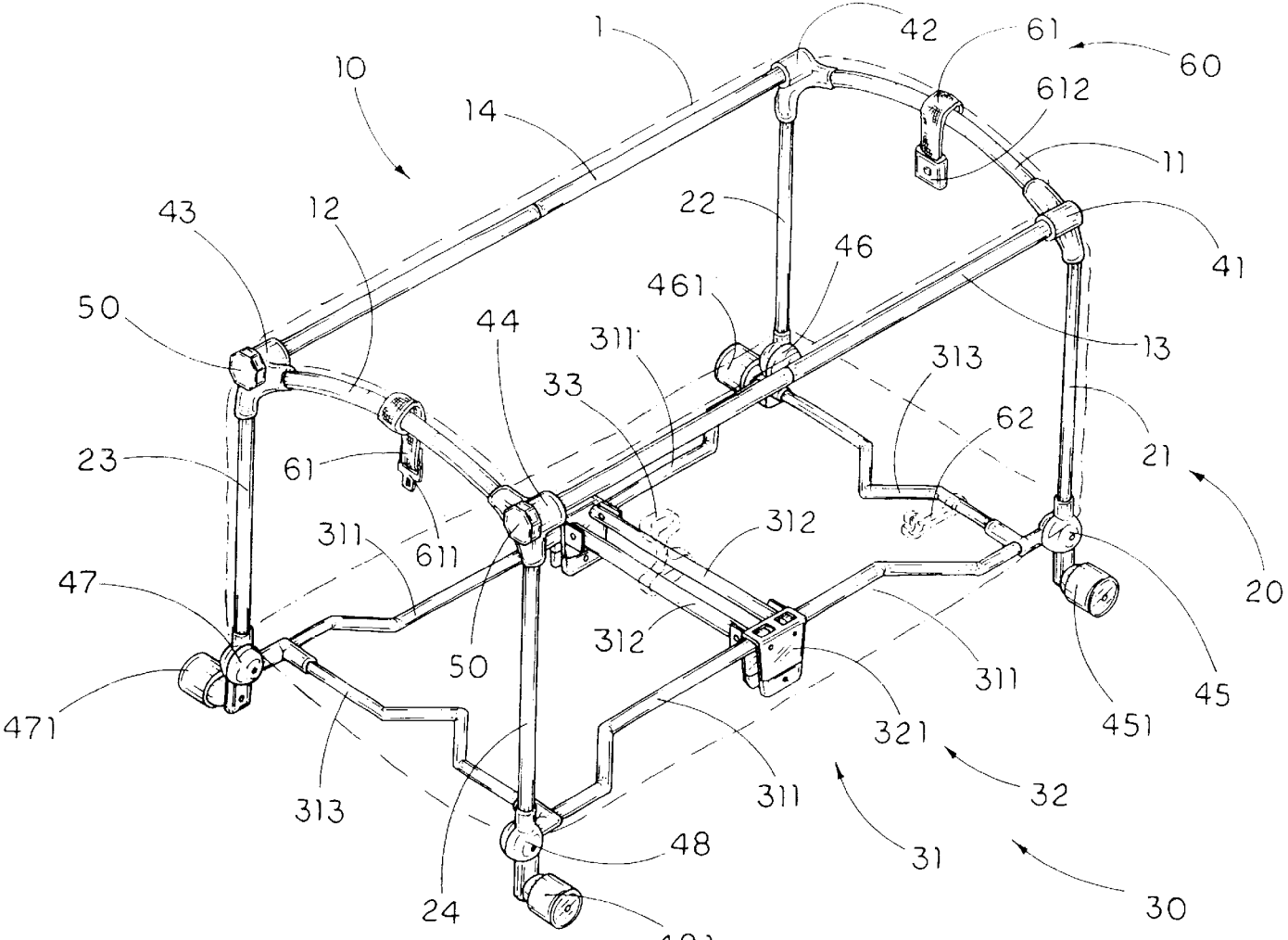
FIG. 1 is a perspective view of a foldable frame for play pen and cot according to a preferred embodiment of the present invention.

Referring to FIG. 1 of the drawings, a foldable frame for play pen and cot according to a preferred embodiment of the present invention is illustrated, wherein the foldable frame is adapted to construct with a fabric made boundary shelter 1 to form the play pen and cot.

The foldable frame comprises a top frame 10 for supporting the boundary shelter 1 thereon comprising a pair of parallel top frame bars 11, 12 and a pair of parallel top frame units 13, 14 to form a rectangular structure wherein each of the top frame units 13, 14 has an affixing end 131, 141 and a locking end 132, 142, a supporting frame 20 comprising tour supporting posts 21, 22, 23, 24, and a base frame 30.

The foldable frame further comprises a pair of first top joints 41, 42, a pair of second top joints 43, 44, four base joints 45, 46, 47, 48, and a rotatable locker 50.

The pair of first top joints 41, 42, each having a transverse tubular sleeve 411, 421, are adapted for connecting two ends of the two top frame bars 11, 12 with upper ends of the two supporting posts 21, 22 respectively.

The pair of second top joints 43, 44, each having a transverse locking slot 431, 441, are adapted for connecting the other two opposed ends of the two top frame bars 11, 12 with upper ends of the other two supporting posts 23, 24 respectively, wherein each of the top frame units 13, 14 is detachably connected between the first top joint 41, 42 and the second top joint 43, 44.

The four base joints 45–48 are adapted for connecting bottom ends of the four supporting posts 21–24 with the base frame 30 respectively wherein four wheels 451, 461, 471, 481 are rotatably mounted on the four base joints 45–48 respectively.

Figure 2:
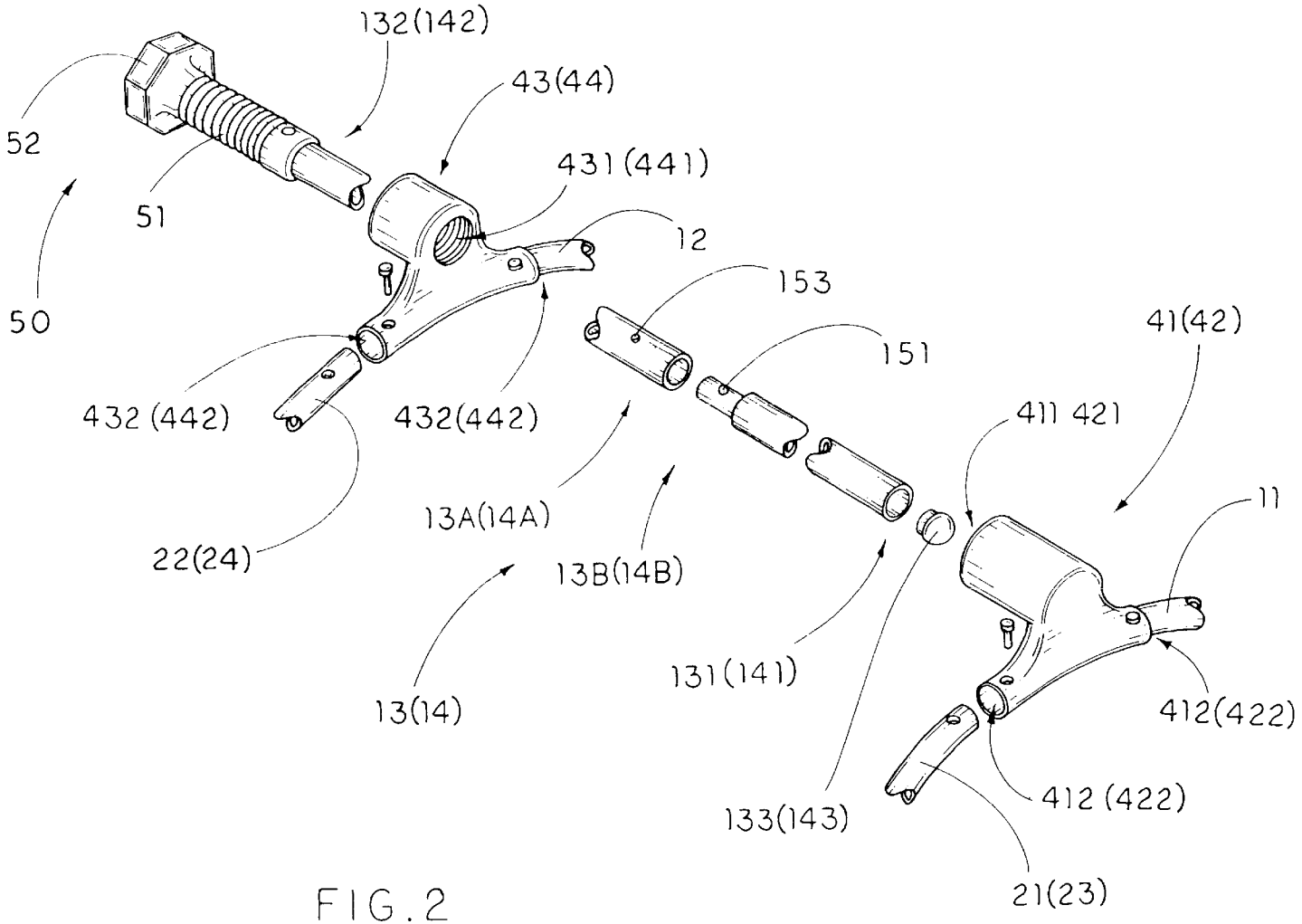
FIG. 2 is an exploded perspective view of a top frame unit of the foldable frame for play pen and cot according to the above preferred embodiment of the present invention.
Figure 3:
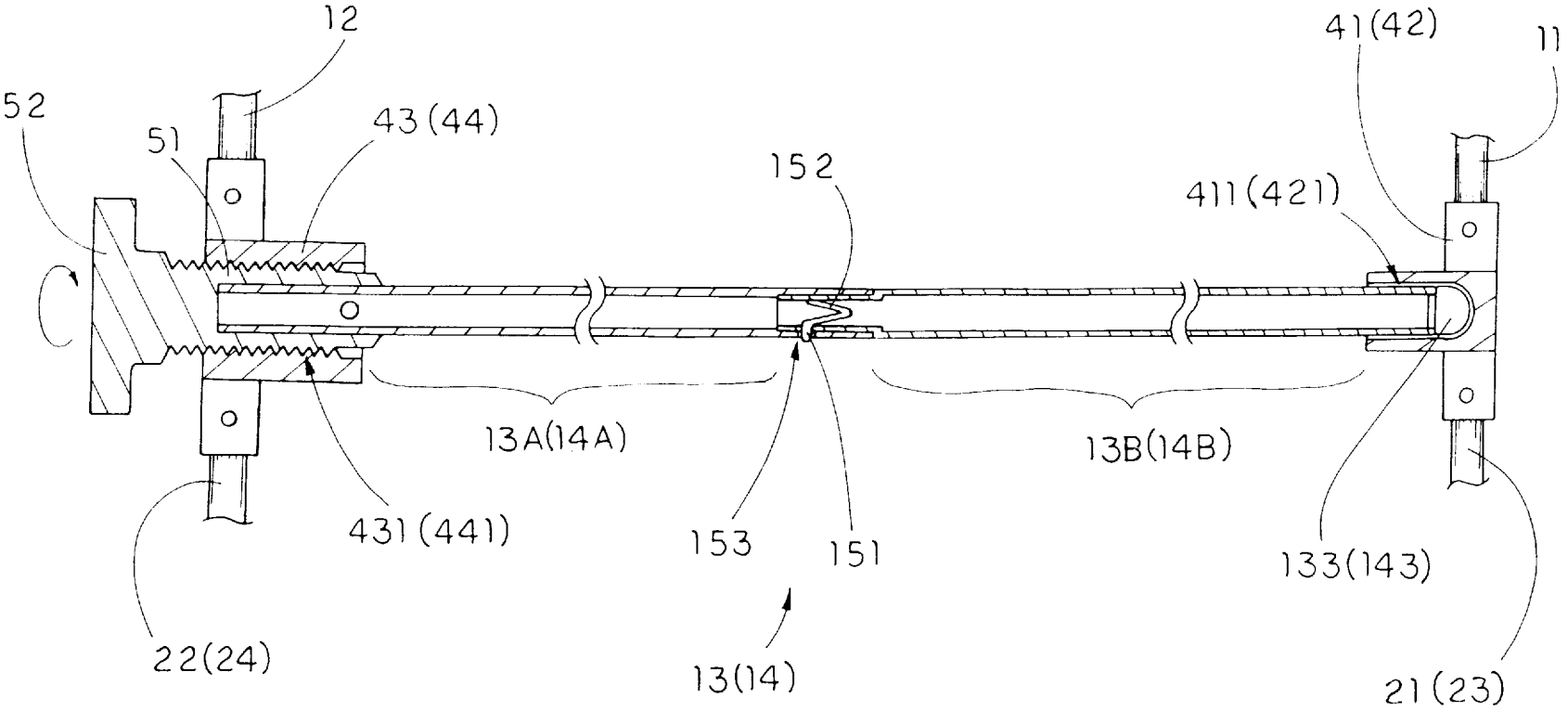
FIG. 3 is a sectional view of the top frame unit of the foldable frame for play pen and cot according to the above preferred embodiment of the present invention.

Referring to FIGS. 2 and 3, the rotatable locker 50 is affixed to each of the locking ends 132, 142 of the top frame units 13, 14 and arranged in such a manner that each top frame unit 13, 14 is slidably penetrated through the locking slot 431, 441 of the second top joint 43, 44 until the affixing end 131, 141 of top frame unit 13, 14 is fittedly inserted into the tubular sleeve 411, 421 of the first top joint 41, 42 and the rotatable locker 50 is adjustably lock up with the second top joint 43, 44, so as to securely lock up the top frame unit 13, 14 between the first and second top joints 41–44.

According to the preferred embodiment, each of the first and second top joints 41–44 has two tubular holders 412, 422, 432, 442 for firmly receiving the end of the respective top frame bar 11, 12 and the upper end of the respective supporting post 21, 22, 23, 24 respectively.

The tubular sleeve 411, 421 of each first top joint 41, 42, which is integrally formed between the two tubular holders 412, 422 thereof, has a diameter slightly larger than a diameter of the top frame unit 13, 14 so as to enable the top frame unit 13, 14 slidably inserted into the first tubular sleeve 411.

The locking slot 431, 441 of each second top joint 43, 44, which is integrally formed between the two tubular holders 432, 442 thereof, has an inner thread portion wherein a diameter of the locking slot 431, 441 is larger than the diameter of the top frame unit 13, 14 such that the top frame unit 13, 14 is adapted for slidably passing through the locking slot 431, 441.

As shown in FIG. 2, each top frame unit 13, 14 is constructed by a first and second tubular frame posts 13A, 13B, 14A, 14B detachably connected each other wherein each first frame post 13A, 14A has a receiving end portion and each second frame post 13B, 14A has a connecting end portion, having a diameter slightly smaller than said receiving end portion of said first frame post, fittedly inserted into the receiving end portion of the first frame post 13A, 14A so as to connect the first frame post 13A, 14A with the second frame post 13B, 14B to form the top frame unit 13, 14.

Each of the top frame unit 13, 14 further comprises a protective cap 133, 143 attached to the affixing end 131, 141 of top frame unit 13, 14 and arranged to bias against an inner end wall of the tubular sleeve 411, 421 of the first top joint 41, 42 for reducing the friction between the affixing end 131, 141 of the top frame unit 13, 14, so as to enable the affixing end 131, 141 of the top frame unit 13, 14 smoothly rotating in the tubular sleeve 411, 421 of the top frame unit 13, 14.

In order to securely connect the first frame post 13A, 14A with the second frame post 13B, 14B, the top frame 10 further comprises a blocking element 151 movable and transversely penetrated through the connecting end portion of the second frame post 13B, 14B and a resilient element 152 disposed in the connecting end portion of the second frame post 13B, 14B for applying an urging pressure on the blocking element 151 so as to normally maintain a head portion of the blocking element 151 exposed to an exterior of the second frame post 13B, 14B in such a manner that when the connecting end portion of the second frame post 13B, 14B is inserted into the receiving end portion of the first frame post 13A, 14A, the head portion of the blocking element 151 is inserted into a locker hole 153 formed on the receiving end portion of the first frame post 13A, 14A, so as to securely lock up the first frame post 13A, 14A with the second frame post 13B, 14B and prevent an Lnwanted rotational movement of the top frame unit 13, 14.

The rotatable locker 50 comprises a thread shank 51 firmly attached to the locking end 132, 142 of the top frame unit 13, 14 by means of rivet, and an enlarged rotating bottom 52 arranged to drive the thread shank 51 to rotate, wherein the thread shank 51 is rotatably and fittedly engaged with the inner thread portion of the locking slot 431, 441 when the top frame unit 13, 14 is slidably passing therethrough, as shown in FIG. 3.

The four supporting posts 21–24 of the supporting frame 20 are identical tubular posts connected between the first and second top joints 41–44 and the base joints 45–48 respectively wherein an interior cavity 49 is defined between the four supporting posts 21–24 to receiving the boundary shelter 1 therein.

Figure 4:
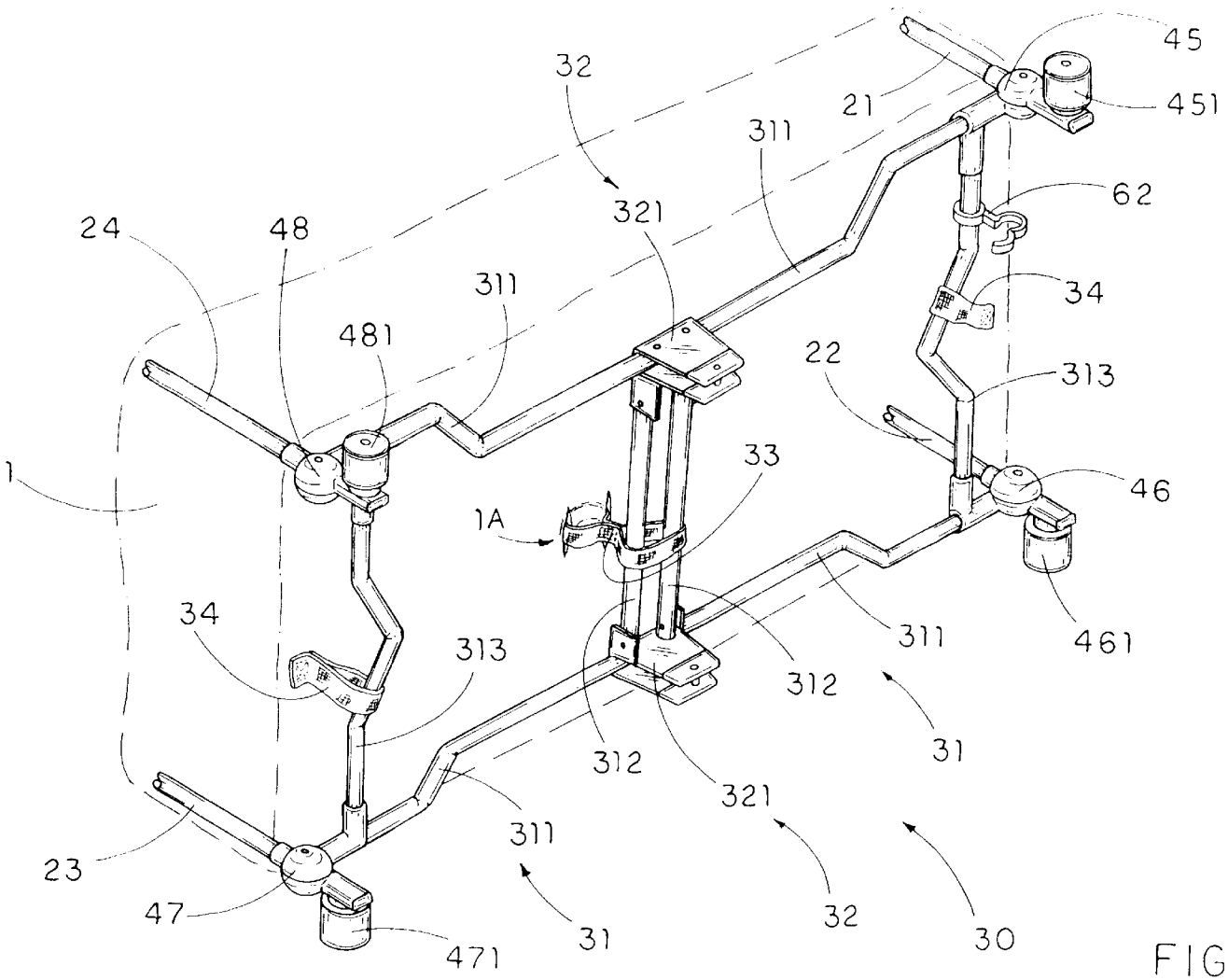
FIG. 4 is a perspective view of a base frame of the foldable frame for play pen and cot according to the above preferred embodiment of the present invention.

As shown in FIG. 4, the base frame 30 comprises a pair of base support apparatus 31 each comprising a pair of identical base support arms 311 wherein an inward end of each base support arm 311 is pivotally connected to the respective base joint 45–48, and two coupling joints 32 each for pivotally connecting an inward end of the base support arm 311 of one base support apparatus 31 with an inward end of the base support arm 311 of another base supporting apparatus 31.

Each coupling joint 32 comprises a standing leg 321 having a predetermined height extended downwardly adapted for steadily sitting on the ground when the foldable frame is unfolded so as to support the structure of the foldable frame.

Each base support apparatus 31 further comprises an inner pillar 312 firmly affixed between the two coupling joints 32 and an outer pillar 313 firmly affixed between two outward end portions of the base support arms 311 wherein the two inner pillars 312 and the two outer pillars 313 are capable of retaining the shape of the foldable frame and enhancing the rigid structure of the foldable frame.

Figure 5:
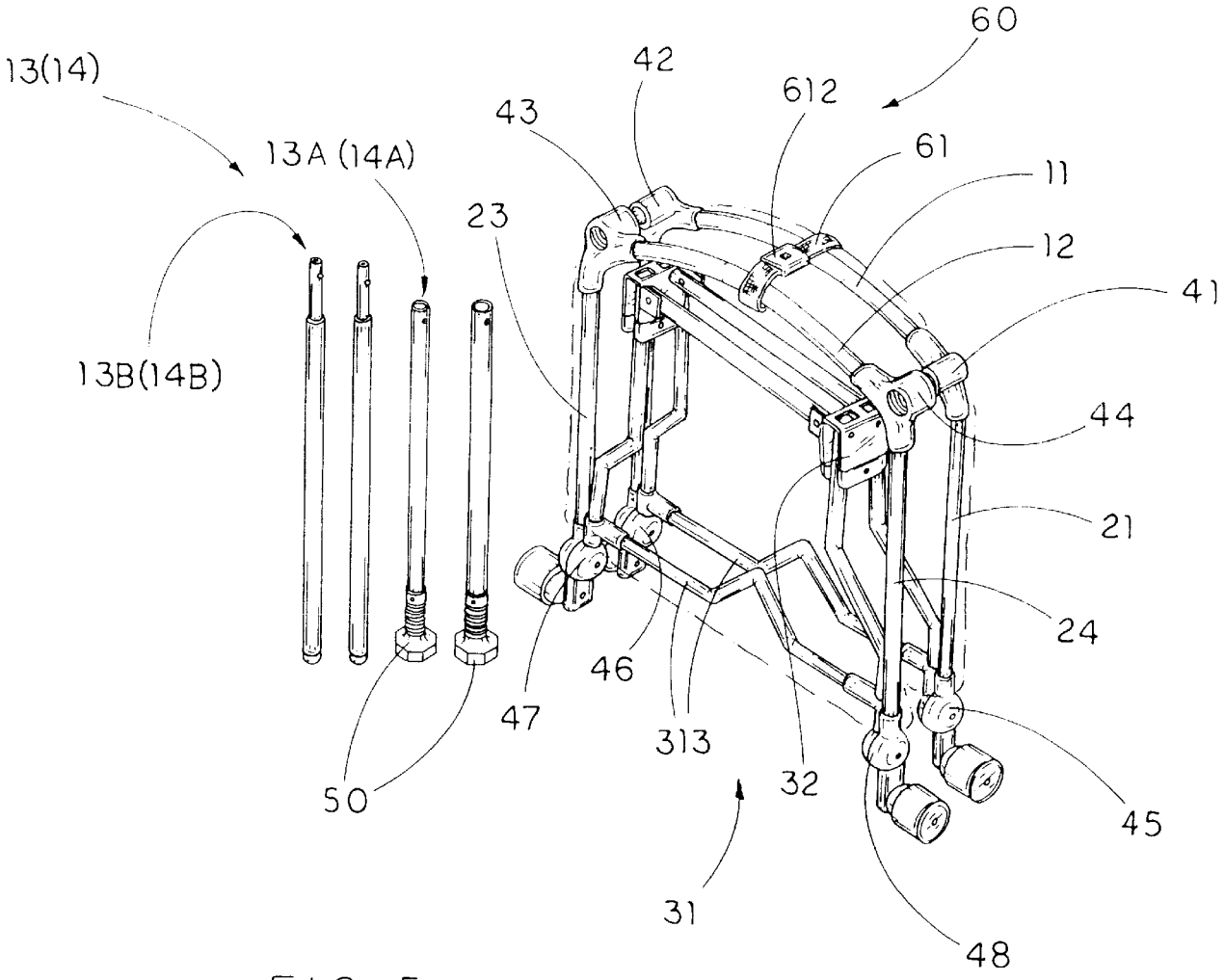
FIG. 5 is a perspective view of the foldable frame for play pen and cot in a folded position according to the above preferred embodiment of the present invention.

The base joint 30 further comprises an elongated element 33 having an affixing end portion affixed to the two inner pillars 312 and a pulling end portion extended through at least a slit 1A formed on a bottom panel of the boundary shelter 1 in such a manner that when an upward pulling force is applied on the pulling end portion of the elongated element 33, the inward ends of the base support arms 311 are arranged to pivotally move upward in opposite directions, so as to fold up the base frame 30 in half, as shown in FIG. 5. Besides, in the folded position of the foldable frame, the two top frame bars 11, 12 are moved towards each other, so as to reduce the foldable frame into a compact size.

The base joint 30 further comprises a pair of elongated reinforcing straps 34 each having two ends attaching to the respective outer pillar 313 and the bottom panel of the shelter boundary 1 so as to reinforce the shape of the shelter boundary 1 when the foldable frame is folded up.

It is worth to mention that in order to fold up the foldable frame, the upward pulling force must be applied on the base frame 30. Therefore, when a baby is sat in the play pen and cot, a downward force which is the weight of the baby will applied on the base frame 30 so as to prevent the foldable frame being folded up accidentally and further enhance the safety of the play pen and cot.

The foldable frame further comprising a fastening means 60 for locking up the foldable frame in the folded position wherein the fastening means 60 comprises a pair of locking belts 61 affixed to the two top frame bars 11, 12 respectively, a buckle plugs 611 and a buckle socket 612 provided at two free ends of the locking belts 61 for fastening the locking belts 61 together by buckling up the buckle plug 611 and the buckle socket 612, and a locking fastener 62 having one end affixed to one of the outer pillars 313 and another free end adapted for affixing to another outer pillar 331 when the foldable frame is folded up.

What is claimed is:

1. A foldable frame for play pen and cot, comprising:

a top frame comprising a pair of parallel top frame bars and a pair of parallel top frame units to form a rectangular structure, wherein each of said top frame units has an affixing end and a locking end;

a supporting frame comprising four supporting posts;

a base frame;

a pair of first top joints, each having a transverse tubular sleeve, connecting two ends of said two top frame bars with upper ends of said two supporting posts respectively;

a pair of second top joints, each having a transverse locking slot, connecting the other two of said ends of two said top frame bars with upper ends of the other two of said supporting posts respectively, wherein each of said top frame units is detachably connected between said first top joint and said second top joint;

four base joints connecting bottom ends of said four supporting posts with said base frame respectively; and a rotatable locker affixed to each of said locking ends of said top frame units and arranged in such a manner that each said top frame unit is slidably penetrated through said locking slot of said second top joint until said affixing end of said top frame unit is inserted into said tubular sleeve of said first top joint and said rotatable locker is adjustably locked up with said second top joint, so as to securely lock up said top frame unit between said first and second top joints.

2. The foldable frame, as recited in claim 1, wherein said rotatable locker comprises a threaded shank firmly attached to said locking end of a respective said top frame unit and an enlarged rotating bottom arranged to drive said thread shank to rotate, wherein said threaded shank is rotatably and fittedly engaged with an inner thread portion of said locking slot when said top frame unit is slidably passing therethrough.

3. The foldable frame, as recited in claim 2, wherein each said top frame unit is constructed by first and second tubular frame posts detachably connected each other wherein each said first frame post has a receiving end portion and each said second frame post has a connecting end portion, having a diameter slightly smaller than said receiving end portion of said first frame post into said receiving end portion of said first frame post so as to connect said first frame post with said second frame post to form said top frame unit.

4. The foldable frame, as recited in claim 3, wherein said top frame further comprises a blocking element movable and transversely penetrated through said connecting end portion of said second frame post and a resilient element disposed in said connecting end portion of said second frame post for applying an urging pressure on said blocking element so as to normally maintain a head portion of said blocking element exposed to an exterior of said second frame post in such a manner that when said connecting end portion of said second frame post is inserted into said receiving end portion of said first frame post, said head portion of said blocking element is inserted into a locker hole formed on said receiving end portion of said first frame post, so as to securely lock up said first frame post with said second frame post.

5. The foldable frame, as recited in claim 3, wherein said base frame comprises a pair of base support apparatus each comprising a pair of identical base support arms wherein an inward end of each base support arm is pivotally connected to a respective said base joint, and two coupling joints each for pivotally connecting an inward end of said base support arm of one said base support apparatus with an inward end of said base support arm of another said base supporting apparatus.

6. The foldable frame, as recited in claim 5, wherein each said coupling joint comprises a standing leg having a predetermined height extended downwardly adapted for steadily sitting on ground when said foldable frame is unfolded.

7. The foldable frame, as recited in claim 6, wherein each said base support apparatus further comprises an inner pillar firmly affixed between said two coupling joints and an outer pillar firmly affixed between two outward end portions of said base support arms wherein said two inner pillars and said two outer pillars are capable of retaining a shape of said foldable frame.

8. The foldable frame, as recited in claim 7, further comprising a boundary shelter supported by said foldable frame wherein said base joint further comprises an elongated element having an affixing end portion affixed to said two inner pillars and a pulling end portion extended through at least a slit formed on a bottom panel of said boundary shelter in such a manner that when said elongated element is pulled upwardly, said inward ends of said base support arms are arranged to pivotally move upward in opposite directions, so as to fold up said base frame in half.

9. The foldable frame, as recited in claim 2, wherein said base frame comprises a pair of base support apparatus each comprising a pair of identical base support arms wherein an inward end of each base support arm is pivotally connected to said respective base joint, and two coupling joints each for pivotally connecting an inward end of said base support arm of one said base support apparatus with an inward end of said base support arm of another said base supporting apparatus.

10. The foldable frame, as recited in claim 9, wherein each said coupling joint comprises a standing leg having a predetermined height extended downwardly adapted for steadily sitting on ground when said foldable frame is unfolded.

11. The foldable frame, as recited in claim 10, wherein each said base support apparatus further comprises an inner pillar firmly affixed between said two coupling joints and an outer pillar firmly affixed between two outward end portions of said base support arms wherein said two inner pillars and said two outer pillars are capable of retaining a shape of said foldable frame.

12. The foldable frame, as recited in claim 11, further comprising a boundary shelter supported by said foldable frame, wherein each said base joint further comprises an elongated element having an affixing end portion affixed to said two inner pillars and a pulling end portion extended through at least a slit formed on a bottom panel of said boundary shelter in such a manner that when said elongated element is pulled upwardly, said inward ends of said base support arms are arranged to pivotally move upward in opposite directions, so as to fold up said base frame in half.

13. The foldable frame, as recited in claim 1, wherein each said top frame unit is constructed by first and second tubular frame posts detachably connected to each other wherein each said first frame post has a receiving end portion and each said second frame post has a connecting end portion, having a diameter slightly smaller than said receiving end portion of said first frame post, fittedly inserted into said receiving end portion of said first frame post so as to connect said first frame post with said second frame post to form said top frame unit.

14. The foldable frame, as recited in claim 13, wherein said top frame further comprises a blocking element movable and transversely penetrated through said connecting end portion of said second frame post and a resilient element disposed in said connecting end portion of said second frame post for applying an urging pressure on said blocking element so as to normally maintain a head portion of said blocking element exposed to an exterior of said second frame post in such a manner that when said connecting end portion of said second frame post is inserted into said receiving end portion of said first frame post, said head portion of said blocking element is inserted into a locker hole formed on said receiving end portion of said first frame post, so as to securely lock up said first frame post with said second frame post.

15. The foldable frame, as recited in claim 1, wherein said base frame comprises a pair of base support apparatus each comprising a pair of identical base support arms wherein an inward end of each base support arm is pivotally connected to a respective said base joint, and two coupling joints each for pivotally connecting an inward end of said base support arm of one said base support apparatus with an inward end of said base support arm of another said base supporting apparatus.

16. The foldable frame as recited in claim 15, wherein each said coupling joint comprises a standing leg having a predetermined height extended downwardly adapted for steadily sitting on ground when said foldable frame is unfolded.

17. The foldable frame, as recited in claim 16, wherein each said base support apparatus further comprises an inner pillar firmly affixed between said two coupling joints and an outer pillar firmly affixed between two outward end portions of said base support arms wherein said two inner pillars and said two outer pillars are capable of retaining a shape of said foldable frame.

18. The foldable frame as recited in claim 17, further comprising a boundary shelter supported by said foldable frame, wherein each said base joint further comprises an elongated element having an affixing end portion affixed to said two inner pillars and a pulling end portion extended through at least a slit formed on a bottom panel of said boundary shelter in such a manner that when said elongated element is pulled upwardly, said inward ends of said base support arms are arranged to pivotally move upward in opposite directions, so as to fold up said base frame in half.

19. The foldable frame, as recited in claim 15, wherein each said base support apparatus further comprises an inner pillar firmly affixed between said two coupling joints and an outer pillar firmly affixed between two outward end portions of said base support arms wherein said two inner pillars and said two outer pillars are capable of retaining a sharp of said foldable frame.

20. The foldable frame, as recited in claim 19, further comprising a boundary shelter supported by said foldable frame wherein each said base joint further comprises an elongated element having an affixing end portion affixed to said two inner pillars and a pulling end portion extended through at least a slit formed on a bottom panel of said boundary shelter in such a manner that when said elongated element is pulled upwardly, said inward ends of said base support arms are arranged to pivotally move upward in opposite directions so as to fold up said base frame in half.

* * * * *